United States Patent [19]

Wilson

[11] Patent Number: 4,471,642

[45] Date of Patent: Sep. 18, 1984

[54] REPLACEMENT STAND FOR ROLLING MILL

[75] Inventor: Alexander I. Wilson, Sheffield, England

[73] Assignee: Hille Engineering Company Limited, Sheffield, England

[21] Appl. No.: 342,795

[22] Filed: Jan. 26, 1982

[30] Foreign Application Priority Data

Jan. 27, 1981 [GB] United Kingdom ..... 8102378

[51] Int. Cl.[3] ..... B21B 31/08

[52] U.S. Cl. ..... 72/238; 72/239; 72/221; 72/247; 72/250

[58] Field of Search ..... 72/237, 238, 239, 250, 72/221, 247

[56] References Cited

U.S. PATENT DOCUMENTS

| | | | |
|---|---|---|---|
| 3,043,170 | 7/1962 | Wales | 72/221 |
| 3,675,456 | 7/1972 | Sieurin | 72/239 |
| 3,712,102 | 1/1973 | Eibe | 72/238 |
| 4,098,107 | 7/1978 | Bruno | 72/237 |
| 4,184,353 | 1/1980 | Sebardt | 72/221 |

*Primary Examiner*—Lowell A. Larson
*Assistant Examiner*—Jorji M. Griffin
*Attorney, Agent, or Firm*—Roberts & Floyd

[57] ABSTRACT

A rod, bar or section mill has a train of rolling mill stands, each of which is attached to a bed plate with which the stand is introduced into, and withdrawn from, the mill. The bed plate carries pedestals on which are secured guides; those guides can be properly located on the bed plate prior to entry of the stand into the mill; on the stand being positioned in the mill, the guides are then automatically located relative to the pass-line and the down-time of the mill on stand replacement is reduced.

10 Claims, 8 Drawing Figures

REPLACEMENT STAND FOR ROLLING MILL

This invention relates to a rolling mill stand and is particularly concerned with a rolling mill, as sometimes used for the rolling of rod, bar and sections, having a number of stands spaced along the pass line and constructed to enable at least some of the stands to be removed bodily from the mill line for servicing and to be replaced by substitute stands.

In such a mill, it is important that product changing should be effected with minimum delay to minimize the down-time of the mill and to maximize its effective use; it is indeed for those reasons that stand changing, rather than roll changing, is chosen for that purpose. At present, time is lost during product changing by the need to remove the guides at each stand before roll removal from the mill and, more importantly, by the need accurately to reposition the guides after the replacement rolls have been brought to the mill line.

An object of the present invention is to facilitate the introduction and removal of a stand from a multi-stand mill, with the aim of keeping the mill down-time to a low figure.

The present invention resides in a replaceable rolling mill stand having a bed plate which is secured to the stand and which is adapted to be removed from the mill with the stand for servicing of the latter and to be introduced into the mill with the stand, and means carried by the bed plate for securing a guide or guides in preselected position relative to the bed plate, whereby the guide or guides may be fitted prior to introduction of the stand to the mill to take up automatically a pass-line position or positions after the stand has been brought to the mill. Advantageously, the bed plate is mounted on wheels which facilitate the movement of the bed plate and stand into and out of the mill.

By having on the bed plate mounting means for the guide or guides, the latter may be fitted prior to introduction of the stand to the mill so as to take up automatically a pass-line position or positions after the bed plate has been brought to the mill. The time-consuming operation of locating the guide or guides accurately in relation to the intended pass-line is then performed away from the mill line, and without consuming potential production time.

Preferably, the stand is secured on the bed plate for adjustment transversely of the pass-line; consequently, in the case of a rod or bar mill, any desired roll groove can be brought into alignment with the pass-line.

Rod and bar mills can have both horizontal and vertical stands. It is an auxiliary feature of this invention to provide means at the mill for rotating the stand complete with guides as described above on introduction into a vertical stand disposition.

Figure 1:
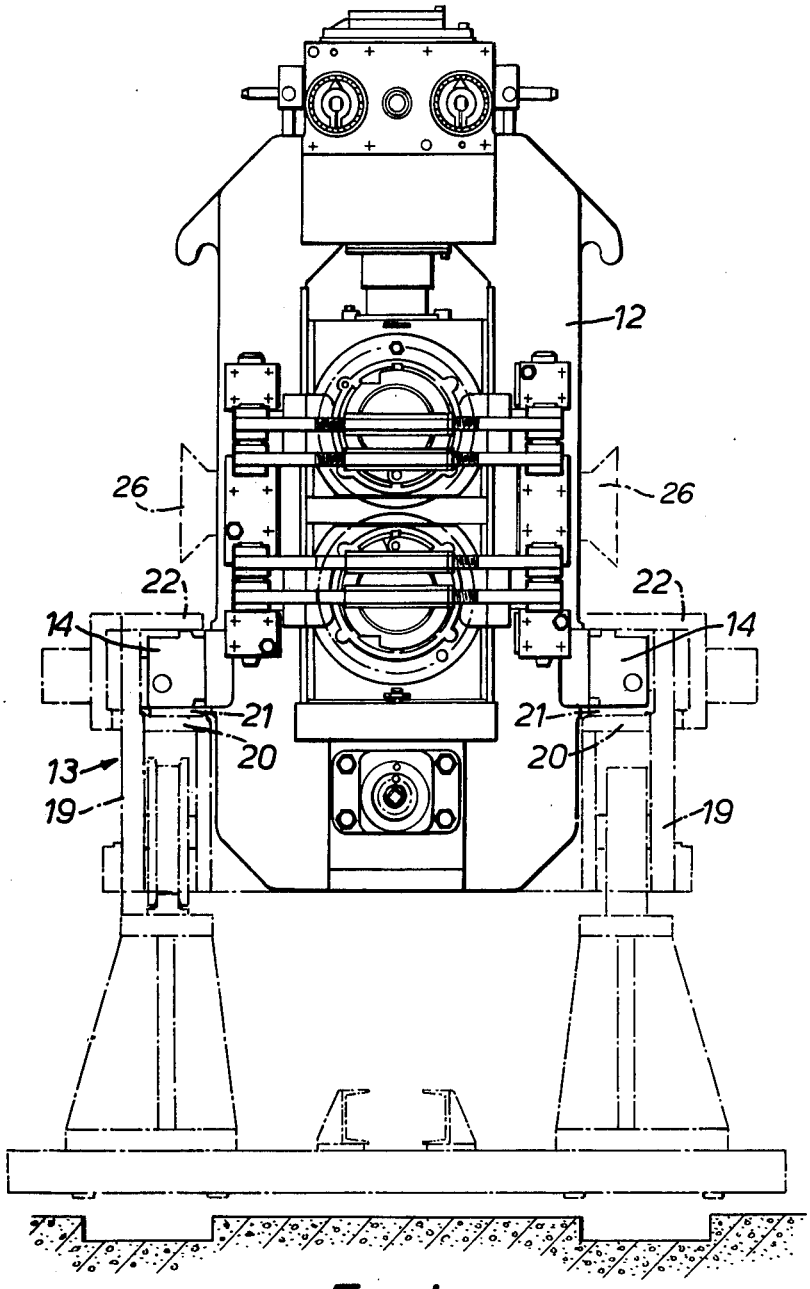
Figure 2:
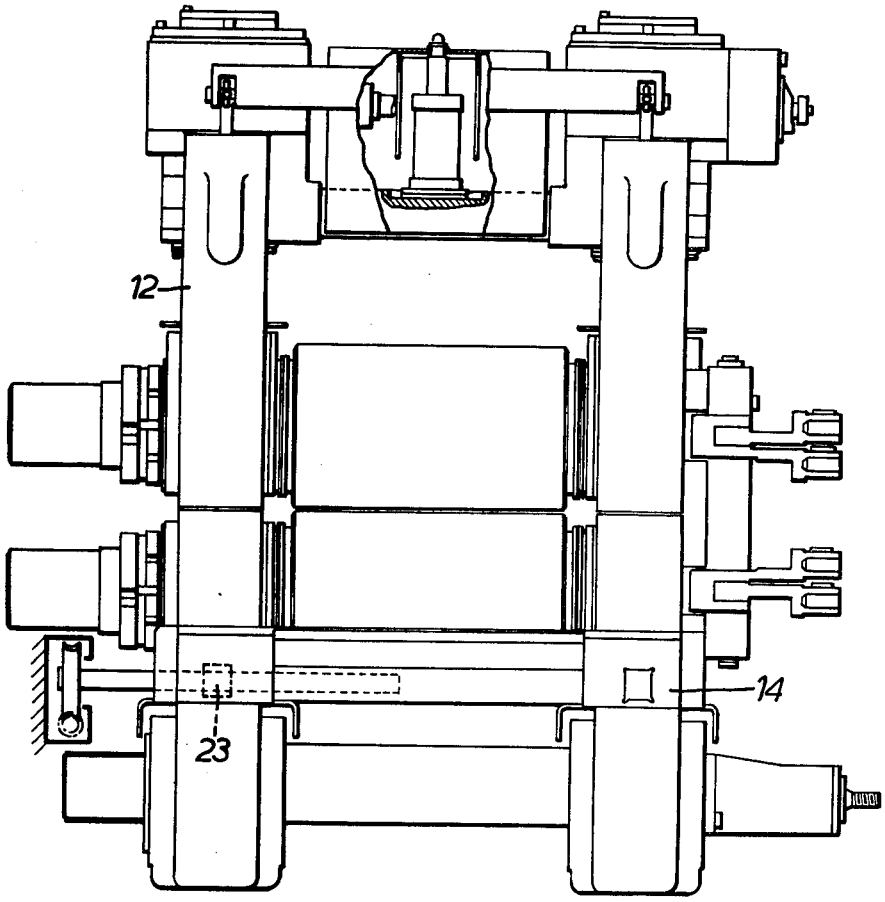
Figure 3:
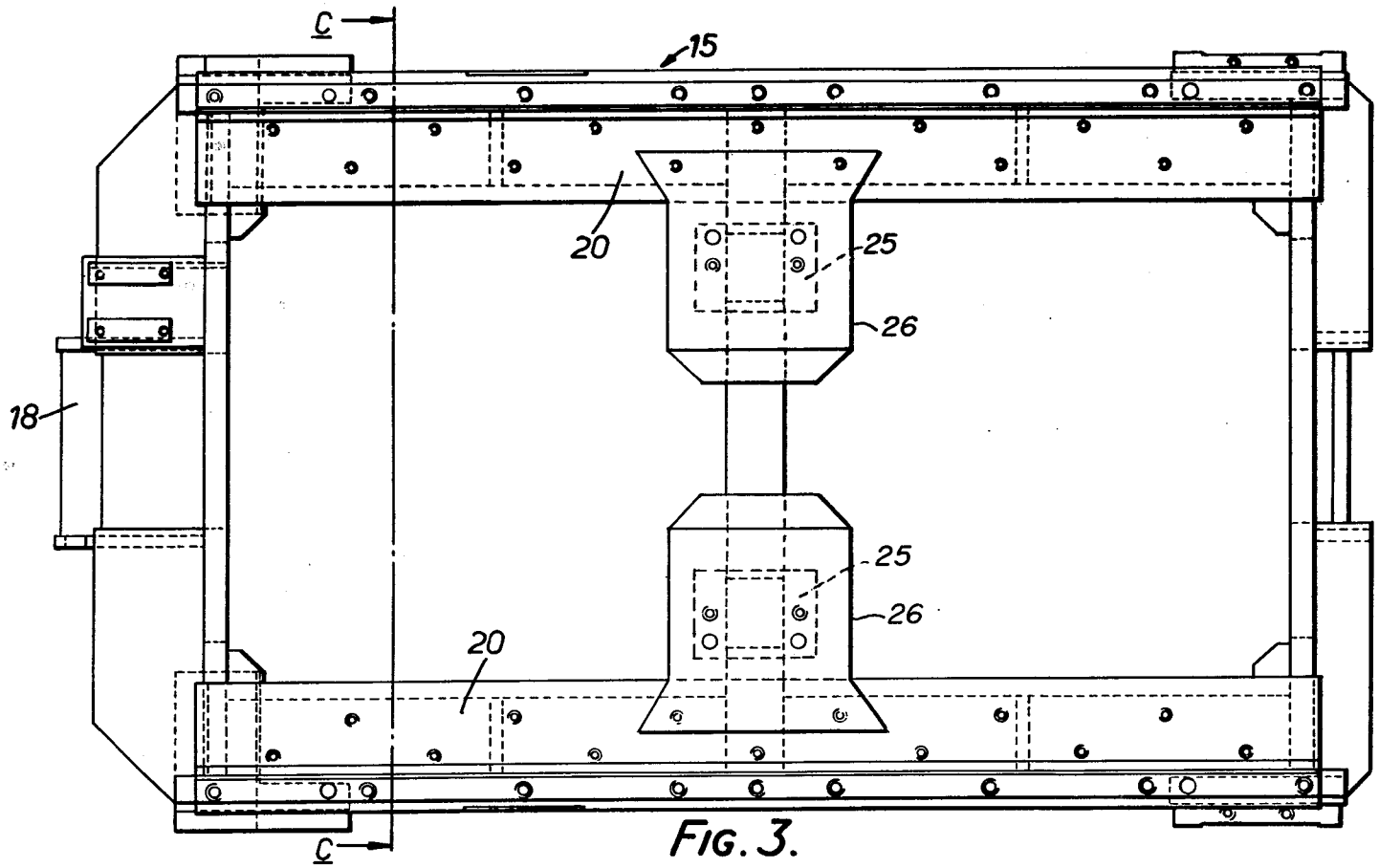
Figure 4:
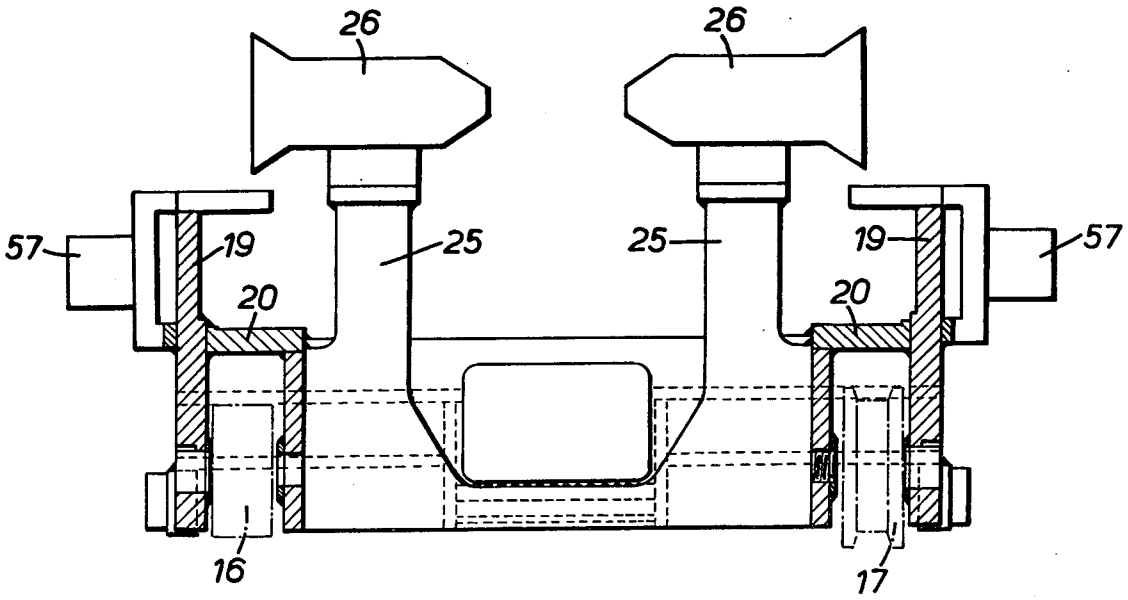
Figure 5:
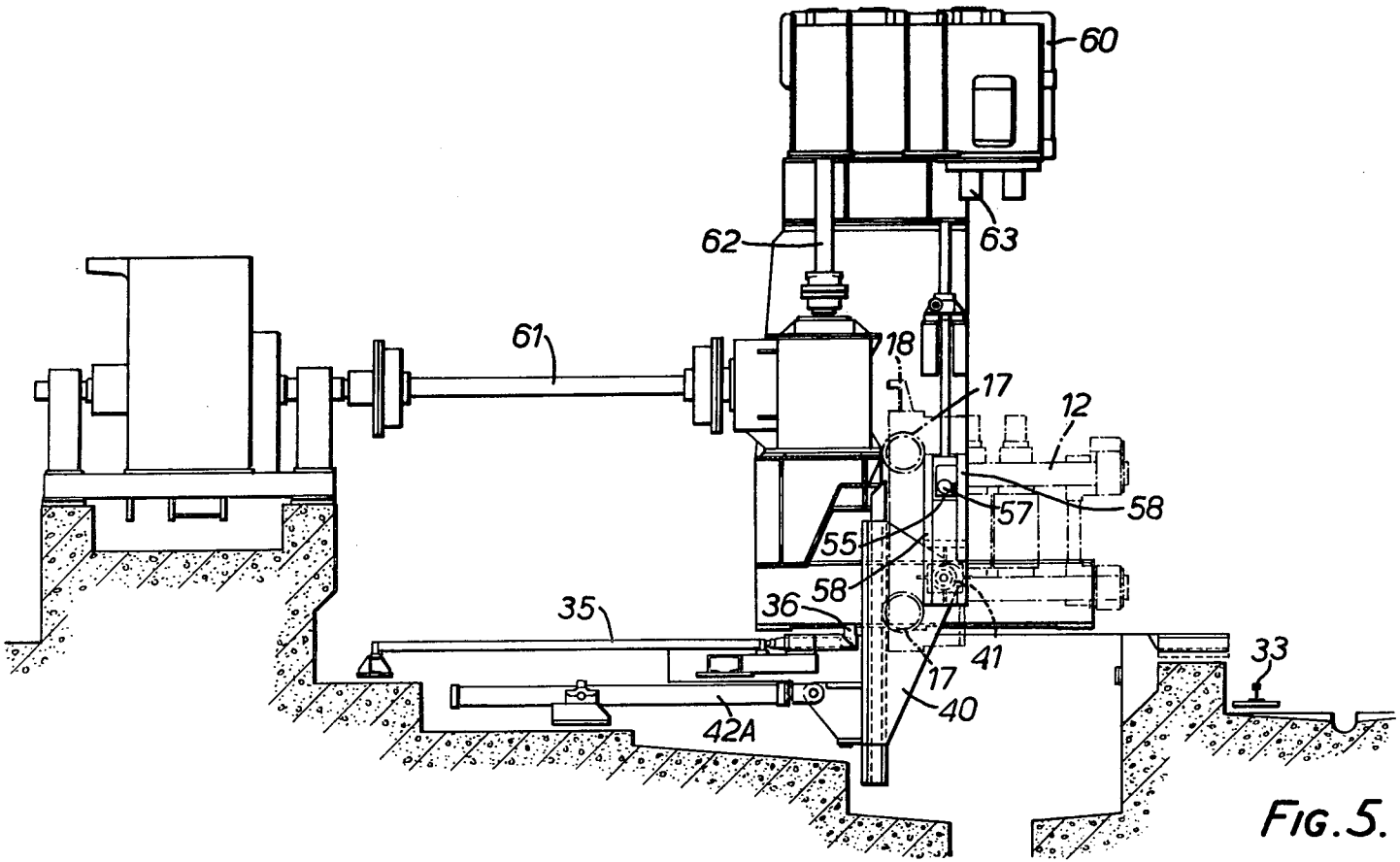
Figure 6:
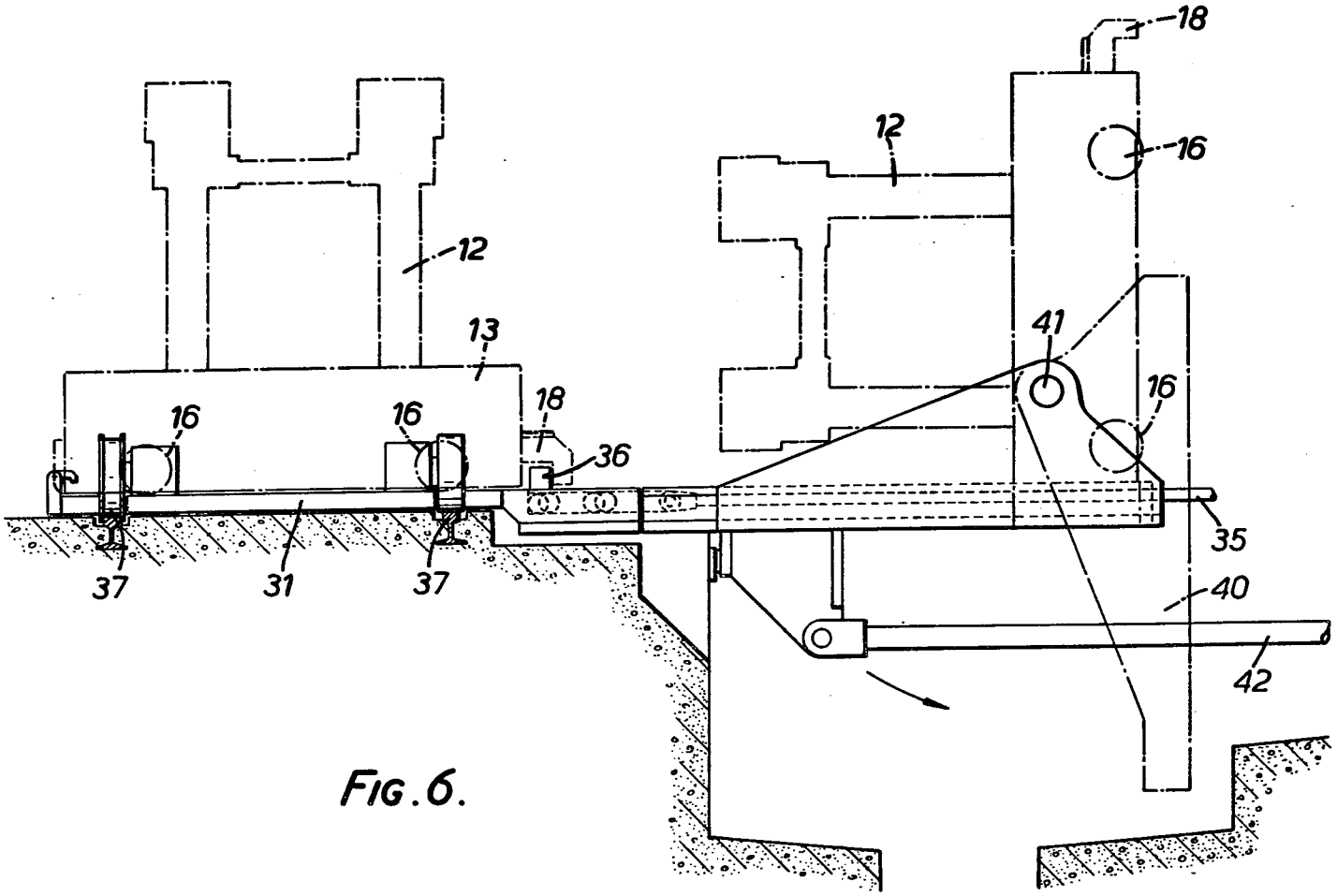
Figure 7:
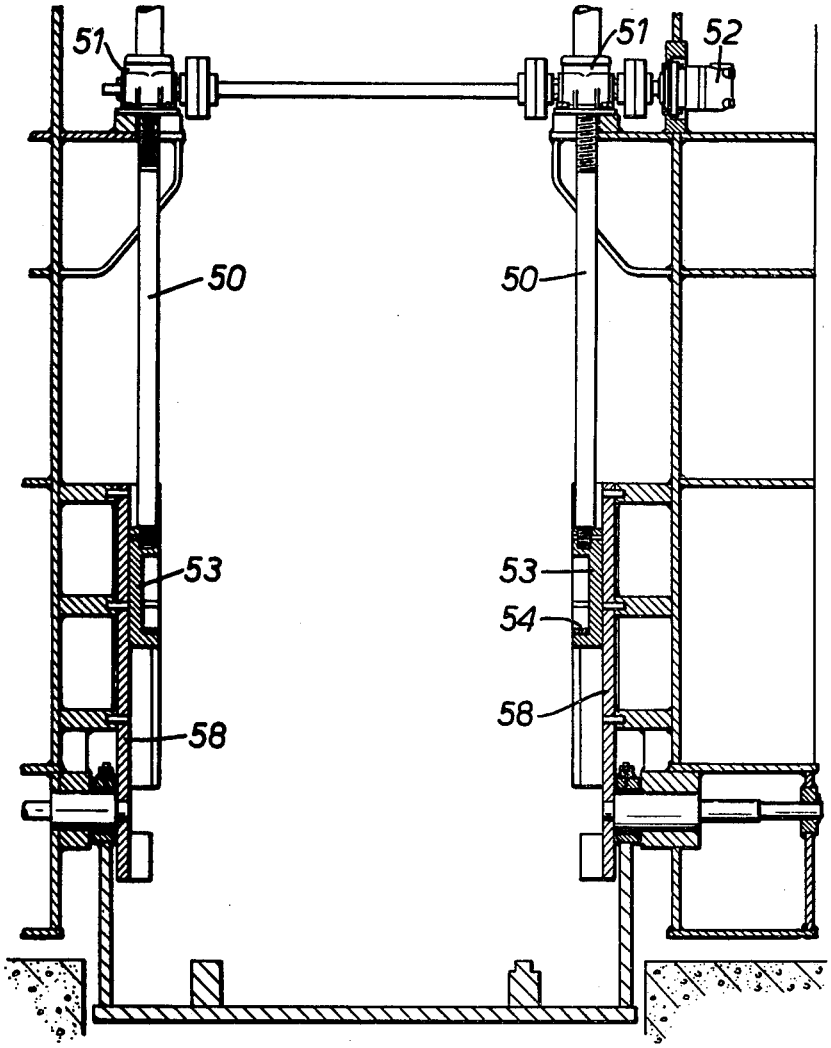
Figure 8:
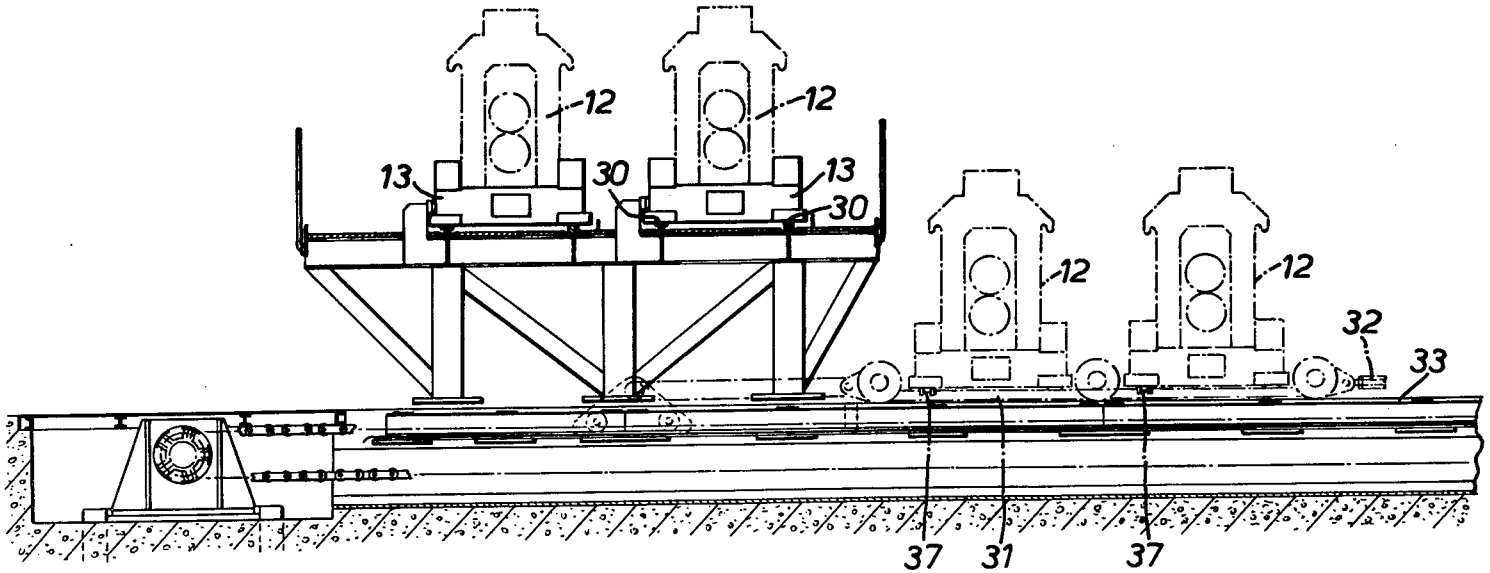

The invention will be more readily understood by way of example from the following description of a rolling mill in accordance therewith, reference being made to the accompanying drawings, in which FIGS. 1 and 2 are respectively an end view and a side view of a stand of a bar and section mill, FIG. 3 is a plan view of the bed plate carriage of the stand of FIGS. 1 and 2, while FIG. 4 is a section on the line C—C of FIG. 3, FIG. 5 shows the arrangement for turning a stand into the vertical disposition, FIG. 6 shows in greater detail the mechanism for rotating the stand, FIG. 7 shows the mechanism for lifting a vertical stand, and FIG. 8 shows the movement of a train of new stands to the rolling mill line.

In FIGS. 1 and 2, a stand of a bar and section mill is indicated generally at 12, mounted on its bed plate carriage 13. The construction of the stand itself is self evident from the drawing and will not be further described, except to point out that the stand housing has a pair of feet 14 extending outwardly at each side.

For roll change and servicing generally, the stand, with its bed plate carriage 13, is bodily removed from the mill line, and is replaced by a substitute stand and bed plate carriage, to keep the down-time of the mill at a minimum. The stand which has been rmoved from the mill can be moved to the roll shop and be serviced whilst the mill is in production. The carriage 13 is permanently associated with the stand, which remains on the carriage, except when it is necessary to separate the two for servicing.

As best shown in FIGS. 3 and 4 the carriage 13 is mounted on two pairs of wheels, of which one pair 16 is unflanged while the other pair 17 is double flanged. At one end the carriage has a C-hook 18 enabling the carriage and stand to be drawn into the mill line, as will be explained subsequently. Each side of the carriage 13 is constituted by an upright plate 19, FIG. 4, from which a plate 20 inwardly projects over the whole length of the carriage, the two plates 20 constituting the bed plate of the stand. The plates 20 are also shown in FIG. 1 and it will be observed that the feet 14 rest on the bedplates through wearing plates 21. The feet are retained on the bedplates by keepers 22 secured to the top of the plates 19 and projecting over the feet. The feet on both sides of the housing contain a captive nut, the position of which is indicated in FIG. 2 at 23. At each side of stand, a screw meshes with the captive nuts on that side of the stand and is connected to a drive system. By operating that drive system, the stand can be adjusted on the bed plate 13 in a direction parallel to the axis of the rolls, in order to bring any selected roll groove to the pass-line. On the centre line of the carriage, there are two spaced pillars 25 on which are mounted stand guides 26 (FIGS. 3 and 4), which, when the carriage is in its position in the mill line are aligned at each side of the rolls with the pass-line.

The operation of stand changing will now be described:

The replacement stands intended to replace those in the rolling line are prepared in the roll shop while the mill is running and the guides 26 are properly positioned on the pillars 25. Prior to stand changing, the replacement stands are moved out of the roll shop on rails 30 (FIG. 8) on which the wheels 16, 17 of the stand carriages run. The stands with their carriages are lifted by crane off the rails 30 on to a series of wheel-mounted bogies 31. Each such bogie 31 is sufficiently long to receive simultaneously two stands and the bogies are connected together by links 32, the whole train being in turn connected to a continuous drive chain by which the train can be moved on rails 33. Each bogie 31 receives only one replacement stand, leaving room for the reception of the stand it is to replace.

The train of bogies 31 carrying the replacement stands 12 are moved on rails 33 parallel to the pass-line until there is a bogie opposite each stand location at which stand changing is to take place. At stand change, the existing stands are released and each is pushed out of the mill line on its carriage 13 by means of a hydraulic piston-and-cylinder assembly 35 (FIG. 5) carrying at its end a hitch 36 which engages with the C-hook 18 (FIG. 3). The stand is moved on a rail for the flanged wheels 17 on to the vacant position of the adjacent bogie 31, which carries a similar and aligned rail 37 (FIG. 8).

When all the stands to be replaced have been moved out of the mill line in the described way, the train of bogies 31 is indexed parallel to the mill line, to bring the replacement stands into line with the stand positions in the mill line. They are then moved on their carriages 13 in a direction normal to the movement of the bogies into the mill line, using the assembly 35 and hitch 36 as before until fixed stops (not shown) are reached. Those stops ensure that each replacement stand is brought to a fixed and predetermined position relative to the mill pass-line with the pre-prepared guides 26 automatically aligned with the pass-line. In the final movement of each stand into its proper location in the mill line, wedges on the underside of each carriage 13 engage with wedges on the foundations to lift the carriage off its wheels and to lock the stand in position. The chain of bogies 31 carrying the withdrawn stands are returned and the stands lifted off the bogies on to the rails 30 (FIG. 8) for subsequent movement to the roll shop and for the necessary servicing.

It is a feature of the present mill that the horizontal stands and the vertical stands, together with their carriages 13, are brought to the mill line in a horizontal disposition, the vertical stands and carriages being simply rotated through 90° to bring the stands to a vertical attitude. The mechanism for turning the stands for vertical use is shown in FIGS. 5 to 7.

At a vertical stand location in the mill line there is a platform 40 (FIG. 6), which is mounted on horizontal pins 41 and which carries rails on which the carriage wheels 16 can run. The platform 40 is moved between its horizontal disposition shown in FIG. 6 in full line, into a vertical disposition shown in chain line, by operation of a piston and cylinder device 42A (FIG. 5) connected with the platform by cylinder rod 42. The replacement stand and its carriage is drawn from the bogey 31 on to the platform 40 by means of the hitch 36; the platform 40 is then turned into its vertical disposition, to bring the stand 12 in position as a vertical stand, as shown in chain line in FIG. 6.

FIG. 5 shows the general arrangement at a vertical stand location, including the hitch 36 and the platform 40. At that location, there is a mechanism for lifting the vertical stand to bring it into the pass-line. That mechanism is best shown in FIG. 7, which shows two screw jacks disposed on opposite sides of the stand 12 and comprising screws 50 supported and driven by nuts which are located in housings 51 and which are driven through worm and worm wheel gears by a motor 52. An elevating member 53 is carried by each screw 50 and has a recess 54 leading to a cradle 55 (FIG. 5). When the replacement stand is drawn on to the (horizontal) platform 40, the cradles 55 are positioned below the pivot pins 41 of the platform. As the stand is drawn by the hitch 36 into the rolling line, a pair of stub axles 57 extending outwardly from the carriage 13 are received in the recesses 54 above the cradles 55. Before the platform 40 is turned into its vertical position as shown in FIG. 5, the motor 52 is operated to lift the members 53 in their slideways 58, first to bring the stub axles 57 into the cradles 55, and then to take the weight of the stand. Platform 40 is then turned into its vertical position after which the stand is moved to its working position by operating the screw jacks 51. Selection of the rolling groove is effected by adjustment of the screw jacks.

FIG. 5 also shows the overhead pinion box 60 which is driven by the mill motor through shafts 61 and 62 and the output shafts 63 of which are coupled through conventional drive spindles to the rolls of the stand 12.

In previously known mills where stand changing is effected, the bed plates are permanently located in the rolling line and it is necessary, after removal of the guides, to release the stands from the bed plates; on the arrival of each replacement stand, that stand must be secured to the existing bed plate and adjusted to bring it to the pass-line. Then, the time-consuming operation of fitting the guides and aligning them accurately with the pass-line must be effected.

In the construction described above an illustrated in the accompanying drawings, the operation of stand replacement is much simplified. Because the bed plates are retained with the stands, the guides can be accurately positioned after servicing of the stands and prior to the stands being brought to the pass-line. Thereby, the down-time required for stand changing is reduced relative to the previous arrangement. In addition, the movement of the stands to and from the mill line is simplified, particularly in the case of vertical stands, and adjustment of the stands for selection of rolling grooves is facilitated.

I claim:

1. A replacement stand for a rolling mill, comprising:

(a) a stand housing;

(b) rolls receivable in said housing;

(c) a bed plate for said housing;

(d) means on said bed plate and on said housing for securing together said bed plate and housing;

(e) said bed plate being constructed to be removed from said mill with said housing and to be introduced into said mill with said housing;

(f) at least one guide for directing the product into the rolls;

(g) means carried by said bed plate for securing said guide at a predetermined location, whereby said guide may be fitted prior to introduction of said stand to said mill to take up automatically a pass-line position when said replaceable stand has been so introduced, and (h) means permitting adjustment of said stand housing on said bed plate in the direction of the axes of said rolls relative to said bed plate and to said guide.

2. A replaceable stand as claimed in claim 1, in which said housing has outwardly extending feet which are received in fittings on said bed plate and there are means for drawing said housing relative to said bed plate.

3. A replaceable stand as claimed in claim 1, in which said bed plate is mounted on wheels facilitating the entry and withdrawal of the stand to and from the mill in a direction transverse to the pass line of said mill.

4. A multi-stand rolling mill having a plurality of replaceable stands arranged along a mill pass-line, each said stand comprising:

(a) a stand housing;

(b) rolls receivable in said housing;

(c) a bed plate for said housing;

(d) means on said bed plate and on said housing for securing together said bed plate and housing;

(e) said bed plate being constructed to be removed from said mill with said housing and to be introduced into said mill with said housing;

(f) at least one guide for directing the product into the rolls;

(g) means carried by said bed plate for securing said guide at a predetermined location, whereby said guide may be fitted prior to introduction of said stand to said mill to take up automatically a pass-line position when said replaceable stand has been so introduced;

(h) means permitting adjustment of said stand housing on said bed plate in the direction of the axes of said rolls relative to said bed plate and to said guide:

and said mill further comprising (i) a track extending parallel to said pass-line; and (j) a trail of bogies on said track for receiving stands withdrawn from said mill.

5. A rolling mill as claimed in claim 4, in which each said bogey is arranged to support simultaneously a replacement stand and a withdrawn stand.

6. A multi-stand rolling mill having a plurality of replaceable stands arranged along a mill pass-line, some of said stands being vertical stands, and each said stand comprising:

(a) a stand housing;

(b) rolls receivable in said housing;

(c) a bed place for said housing;

(d) means on said bed plate and on said housing for securing together said bed plate and housing;

(e) said bed plate being constructed to be removed from said mill with said housing and to be introduced into said mill with said housing;

(f) at least one guide for directing the product into the rolls;

(g) means carried by said bed plate for securing said guide at a predetermined location, whereby said guide may be fitted prior to introduction of said stand to said mill to take up automatically a pass-line position when said replaceable stand has been so introduced;

(h) means permitting adjustment of said stand housing on said bed plate in the direction of the axes of said rolls relative to said bed plate and to said:

(i) and said mill further comprising, at the location of each said vertical stand, means for rotating a stand between a horizontal disposition and a vertical disposition.

7. A rolling mill as claimed in claim 6, in which said rotating means comprise a pivoted platform for receiving a stand in horizontal disposition and a drive mechanism for rotating said platform to bring said stand into vertical disposition.

8. A rolling mill as claimed in claim 6, including an elevating mechanism for raising and lowering a stand in vertical disposition to and from its working position.

9. A rolling mill as claimed in claim 8, in which said elevating mechanism includes cradles which receive stub shafts on said stand when said stand is turned from horizontal to vertical disposition by said rotating means.

10. A rolling mill comprising a plurality of replaceable stands, each comprising:

(a) a stand housing;

(b) rolls receivable in said housing;

(c) a bed plate for said housing;

(d) means on said bed plate and on said housing for securing together said bed plate and housing;

(e) said bed plate being constructed to be removed from said mill with said housing and to be introduced into said mill with said housing;

(f) means carried by each of said bed plates for securing at least one guide, whereby the said guide for each bed plate is fitted prior to the introduction of the said stand into the rolling mill line, so that each guide automatically takes up a pass-line position when the replaceable stands have been so introduced and the guides of the stands are thus aligned with each other.

(h) means permitting adjustment of said stand housing on said bed plate in the direction of the axes of said rolls relative to said bed plate and to said guide.

* * * * *